United States Patent [19]

Heyer et al.

[11] Patent Number: 4,564,118

[45] Date of Patent: Jan. 14, 1986

[54] ADJUSTABLE SLIDE TRAY

[75] Inventors: Robert E. Heyer, Milltown; Michael A. Tannenbaum, Freehold, both of N.J.

[73] Assignee: E. R. Squibb & Sons, Inc., Princeton, N.J.

[21] Appl. No.: 688,089

[22] Filed: Dec. 31, 1984

[51] Int. Cl.[4] ..... B65D 6/04; B65D 6/16

[52] U.S. Cl. ..... 220/8

[58] Field of Search ..... 220/8

[56] References Cited

U.S. PATENT DOCUMENTS

| | | | |
|---|---|---|---|
| 382,716 | 5/1888 | Matthews | 220/8 |
| 779,262 | 1/1905 | Burke | 220/8 |
| 876,235 | 1/1908 | Quackenboss | 220/8 |
| 1,858,179 | 5/1932 | Bay | 220/8 |
| 2,627,801 | 2/1953 | Danziger | 220/8 |
| 3,140,777 | 7/1964 | Gordan | 220/8 |

*Primary Examiner*—George E. Lowrance

*Attorney, Agent, or Firm*—Lawrence S. Levinson; Sanford J. Asman

[57] ABSTRACT

An adjustable slide tray made of a base and a sliding tray which fits within the base is described. The slide tray unit may be used for holding such objects as medicines in a pharmacist's refrigerator. The slide tray unit also includes interlock means for holding trays together.

3 Claims, 6 Drawing Figures

ADJUSTABLE SLIDE TRAY

BACKGROUND OF THE INVENTION

The present invention relates to an adjustable slide tray of the type used for organizing refrigerated products on a shelf.

Certain medicines are kept in refrigerators by pharmacists until they are dispensed. A tray used to hold such products in individual cartons helps to organize the pharmacist's refrigerator, thereby keeping a group of products together and preventing them from being scattered around the refrigerator. In order to conserve space within the refrigerator, and to help organize the products, it would be desirable to have a tray which holds individual products in cartons. It would also be desirable to have the tray have a size which corresponds to the number of cartons held in the tray and to have the tray constructed with interlocks capable of locking one tray to another in order to thereby help maintain organization within the refrigerator.

SUMMARY OF THE INVENTION

A slide tray which is capable of adjusting in size to correspond to the number of products held in the tray is made up of a two part device in which a sliding tray slides within guides on a base. The base includes interlocks capable of locking one tray to another.

DETAILED DESCRIPTION OF THE PREFERRED EMBODIMENT

Figure 4:
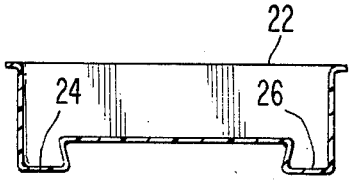
FIGS. 4 and 5 are cross-sectional views taken along the lines 4—4 and 5—5, respectively, of FIG. 3.
Figure 1:
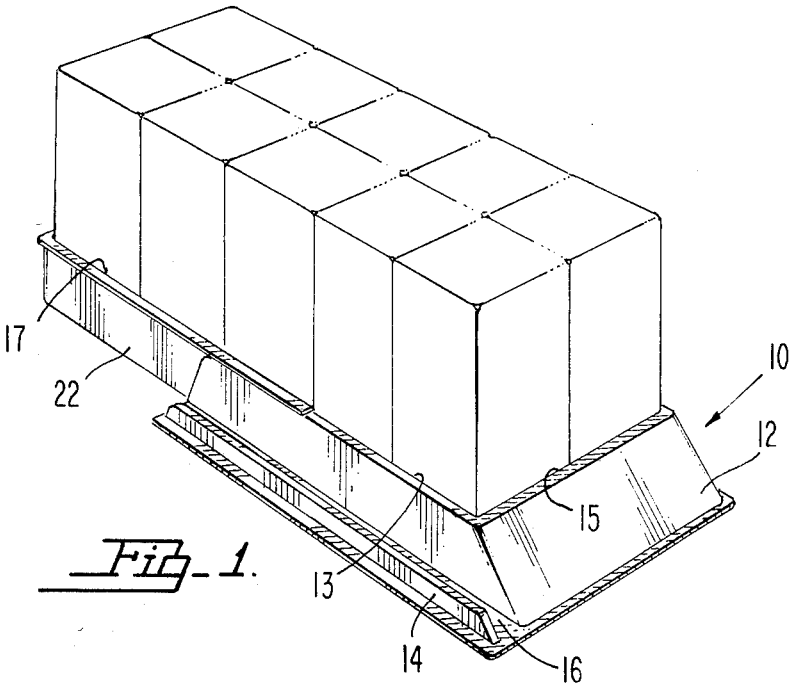
FIG. 1 is a perspective view of the adjustable slide tray of the present invention in its open position holding 10 cartons of medicine.
Figure 2:
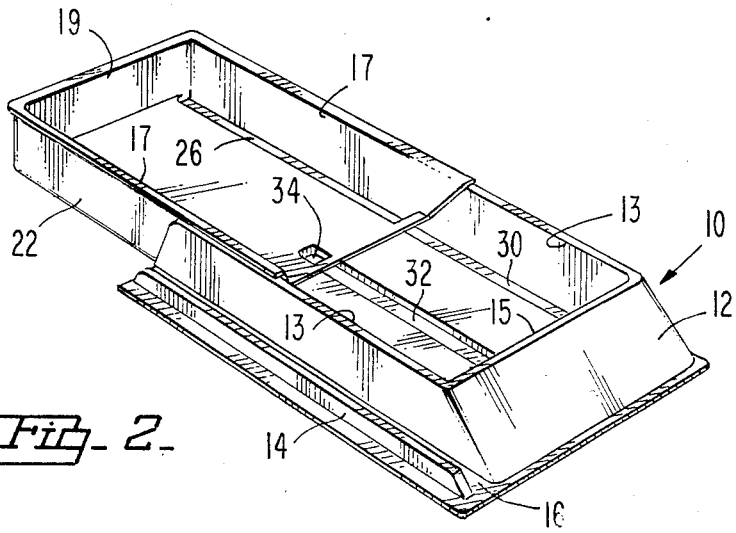
FIG. 2 is a perspective view of an open, empty slide tray.
Figure 3:
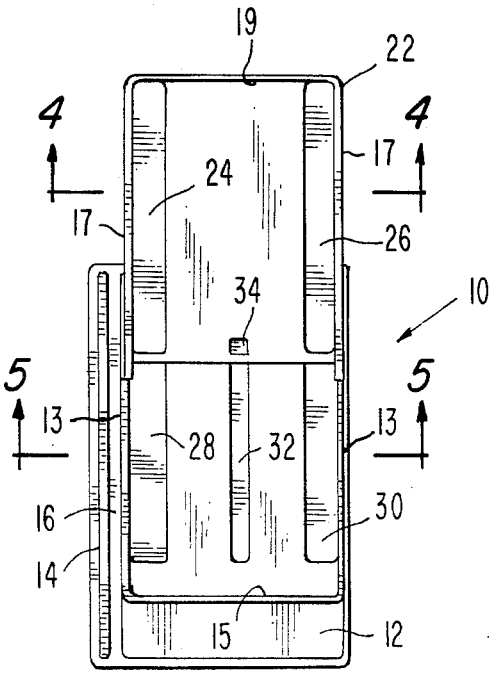
FIG. 3 is a top view of an open, empty slide tray.
Figure 6:
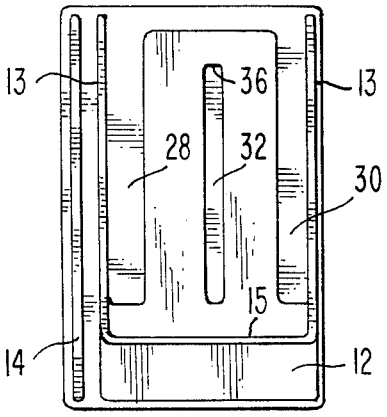
FIG. 6 is a top view of the base portion of the adjustable slide tray.

Referring generally to FIG. 1, the present invention is an adjustable slide tray 10 which includes a base 12 and a sliding tray 22. In the preferred embodiment of the invention, the adjustable slide tray 10 is made up of vacuum formed plastic components.

Figure 5:
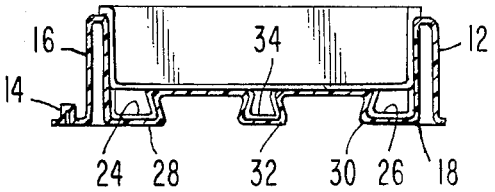

The base 12 includes a raised interlock 14 on one side 16 which is designed to fit into a slot 18 located on the other side of the base 12 (see FIG. 5). Accordingly, groups of adjustable slide trays 10 may be interconnected and locked together using the interlock 14 on one base 12 and the slot 18 on the next adjacent base 12. The base 12 has a front wall 15 and pair of side walls 13. The base 12 is opened at its rear to receive the sliding tray 22 which has a pair of side walls 17 and a rear wall 19. The sliding tray 22, which is open at its front to fit into the open rear of the base 12, is affixed to the base 12 using a pair of dovetailed guides 24, 26 which fit into corresponding dovetailed slots 28, 30, respectively, in the base 12. An additional dovetailed slot 32 is formed in the base 12, as shown in FIGS. 2, 3, 5, and 6.

In the preferred embodiment 10, a substantially rectangular slide stop 34 fits into the slot 32 in the base 12. The travel of the slide stop 34 is limited by the rear end 36 of the slot 32, which does not extend to the end of the base 12, as do the slots 28, 30. The combination of the guides 24, 26, slots 28, 30, 32, and the slide stop 34 permit the sliding tray 22 to slide within the base 12 thereby adjusting the overall size of the slide tray assembly.

In order to manufacture the adjustable slide tray 10, the two component parts 12, 22 are formed of relatively thin, vacuum formed plastic. The plastic must be thin enough to be somewhat resilient in order to allow the dovetailed guides 24, 26 and the slide stop 34, all on the sliding tray 22, to be pressed into their corresponding slots 28, 30, 32, thereby assembling the unit 10. The dovetailing of the guides 24, 26, with their respective slots 28, 30, serves to hold the assembled unit 10 together.

In the preferred embodiment of the slide tray 10, styrene plastic having a thickness of about 25 mils is used. However, other materials having different thicknesses could be used without departing from the present invention.

We claim:

1. An adjustable tray comprising:

(a) a base unit having a substantially rectangular shape having a bottom, a front wall, and two side walls, there being a pair of dovetailed slots extending along the interiors of said side walls from said front wall out the open rear portion of said base, there being at least one dovetailed slot in said base which does not extend beyond said open rear of said base, said base unit being made of a relatively thin, vacuum formed plastic;

(b) a sliding tray having a rear wall and two side walls, said sliding tray having a pair of dovetailed guides which fits within said pair of dovetailed slots in said side walls of said base, whereby said sliding tray may be slid in and out of the base, thereby adjusting the overall size of the slide tray unit, said sliding tray including slide stop means comprised of a substantially rectangular dovetailed portion which extends down from the bottom of said sliding tray into said slot in said base which does not extend out of the rear portion of said base for limiting the rearward travel of said sliding tray, said sliding tray being made of the same relatively thin, vacuum formed plastic material as said base unit.

2. The adjustable tray of claim 1 wherein said plastic is styrene.

3. The adjustable tray of claim 2 wherein said plastic is about 25 mils thick.

* * * * *